US005770244A

United States Patent [19]

Braungardt et al.

[11] Patent Number: 5,770,244

[45] Date of Patent: Jun. 23, 1998

[54] MOLD FOR THE PRODUCTION OF SHAPED BRICKS

[75] Inventors: Rudolf Braungardt, Legenfeld; Erwin Schmucker, Schelklingen, both of Germany

[73] Assignee: Kobra Formen - und Anlagenbau GmbH, Lengenfeld, Germany

[21] Appl. No.: 677,418

[22] Filed: Jul. 9, 1996

[30] Foreign Application Priority Data

Aug. 30, 1995 [DE] Germany ..... 195 31 800.5

[51] Int. Cl.[6] ..... B28B 1/14; B28B 13/06

[52] U.S. Cl. ..... 425/443; 425/441; 425/454; 249/161

[58] Field of Search ..... 425/441, 443, 425/432, 434, 456, 454; 249/161

[56] References Cited

U.S. PATENT DOCUMENTS

| | | | |
|---|---|---|---|
| 3,071,833 | 1/1963 | Tumey | 249/161 |
| 3,071,834 | 1/1963 | Tumey | 249/161 |
| 4,005,972 | 2/1977 | Sommers | 425/443 |
| 4,156,517 | 5/1979 | Schmucker et al. | 249/161 |
| 4,725,214 | 2/1988 | Piazza et al. | 425/454 |
| 5,393,033 | 2/1995 | Wilson | 249/161 |
| 5,397,227 | 3/1995 | Metten | 425/443 |

FOREIGN PATENT DOCUMENTS

| | | | |
|---|---|---|---|
| 6285830 | 10/1994 | Japan | 249/161 |
| 880741 | 11/1981 | U.S.S.R. | 249/161 |
| 1192998 | 11/1985 | U.S.S.R. | 249/161 |

*Primary Examiner*—Jay H. Woo
*Attorney, Agent, or Firm*—Edmund M. Jaskiewicz

[57] ABSTRACT

A mold, for the production of concrete shaped bricks having one or more inclined side walls, has an inclined side wall which together with the opposed vertical mold side wall diverges upwardly to form an angle that is opened upwardly, the inclined side wall is moved upwardly in the direction of inclination in order to open the mold and to enable the shaped bricks to be removed from the mold. The movement of the inclined side wall along the inclined space of the shaped brick during removal of the mold results in a smooth clean even surface.

9 Claims, 4 Drawing Sheets

MOLD FOR THE PRODUCTION OF SHAPED BRICKS

FIELD OF THE INVENTION

The present invention relates to a mold for the producion of shaped bricks formed from free-flowing concrete or concrete-like material, more particularly, to such a mold having one or more mold cavities defined by vertical side walls and in each cavity a mold wall is inclined with respect to the opposite mold wall in that cavity to define an angle which opens upwardly.

BACKGROUND OF THE INVENTION

In the production of concrete shaped bricks in molds having straight, vertical side walls, the mold is generally moved upwardly with respect to the concrete brick in order to remove the finished concrete brick from the mold. During this movement, the vertical side walls of the mold move along the outer sides of the concrete brick to produce a smooth surface which imparts a pleasing appearance to the concrete brick and prevents shrinkage and irregularities from developing on the outer sides of the concrete brick during removal of the brick from the mold. However, it is not possible with such a mold and with this known production process to produce shaped bricks having a side wall that is inclined to the vertical, such as, for example, stairs or steps.

It has also been known to produce concrete shaped blocks with side walls that diverge upwardly by using manually or mechanically operated tipping molds. In such a case, the mold that is filled with concrete is pivoted 180° and the finished concrete shaped block is placed on a steel base. In such a process, a good surface is achieved only on that side of the shaped block that rests on the steel base. The finished surface of the inclined side is generally not particularly smooth. This process has a further disadvantage that it is expensive, time consuming and entirely unsuitable for efficient production.

It has also been known to move one or more side walls of the mold in the horizontal direction in order to remove the concrete block from the mold. When this is done, however, a smooth and clean surface is not achieved since the concrete fills up on the side wall of the block from which the side wall of the mold has been moved and is not smoothed out.

SUMMARY OF THE INVENTION

It is therefore the principal object of the present invention to provide a novel and improved mold for the production of shaped bricks which have at least one side thereof inclined.

It is another object of the present invention to provide such a mold which ensures precise shaping and a clean smooth surface on all surfaces of the finished shaped brick.

It is a further object of the present invention to provide a mold of simplified construction which is inexpensive to maintain and is suitable for efficient production of shaped bricks each having an inclined surface.

The objects of the present invention are achieved and the disadvantages of the prior art are eliminated by providing a mold in which inclined mold walls of the mold cavities can be moved upwardly individually or together in the direction in which they are inclined so as to move along the inclined surface of the shaped brick during the removal of the brick from the mold.

According to one aspect of the present invention, a mold for the production of shaped brick has one or more mold cavities and each mold cavity has a longitudinal vertical side wall, opposed end vertical side walls and an inclined longitudinal side wall. The inclined longitudinal side wall diverges-upwardly with respect to the opposed longitudinal side walls in a mold cavity so as to define an upwardly opening angle therewith. Means are further Provided for moving each of the inclined side walls upwardly in the direction in which each wall is inclined in order to open the mold so that shaped brick can be removed. The inclined side wall thus moves both vertically and horizontally during opening of the mold.

A significant advantage is achieved from the mold of the present invention since the inclined mold wall is moved along its direction of inclination when the mold is being opened to remove the brick there from and this movement shapes the inclined surface of the brick. The oblique side wall of the finished shaped brick thus receives a clean smooth surface similar to the surfaces of the vertical side walls which are also smoothed out during removal of the mold from the brick because of the vertical movement of the mold. In addition, self-cleaning of the mold walls is achieved.

BRIEF DESCRIPTION OF THE DRAWINGS

Other objects and advantages of the present invention will be apparent upon reference of the accompanying description when taken in conjunction with the following drawings, which are exemplary, wherein.

DESCRIPTION OF THE PREFERRED EMBODIMENTS

Proceeding next to the drawings wherein like reference symbols indicate the same parts throughout the various views a specific embodiment and modification of the present invention will be described in detail.

Figure 1:
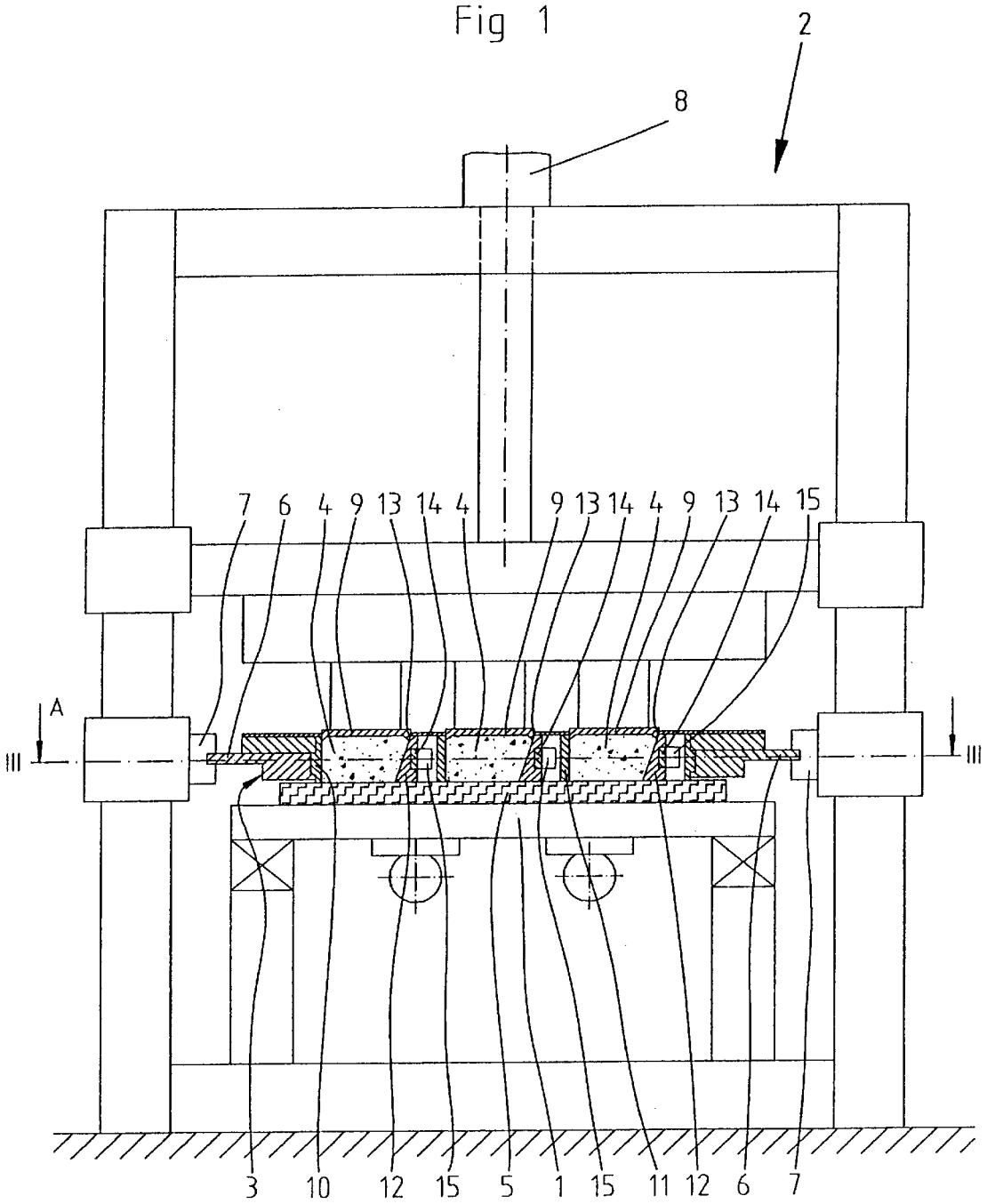
FIG. 1 is a front elevational view of the molding machine incorporating the mold according to the present invention and partially cut away.

In FIG. 1, there is indicated generally at 2 a molding machine having a mold 3 with several mold cavities 4 which is placed on a vibrating table 1. Upon completion of the molding process, the mold 3 is raised sufficiently to permit the insertion of a storage board 5 on the vibrating table 1. The mold 3 is provided with lateral projection 6 which are detachably mounted to vertically movable support 7 on the molding machine 2. The movable support 7 can be driven by piston-cylinder units which are not illustrated.

A piston-cylinder unit 8 mounted on the molding machine 2 drives pressure plates 9 which rest upon mold cavities 4 that are filled with concrete compound and are vertically movable in a known manner. The pressure plates 9 correspond in number to the mold cavities 4 so as to form the top walls for the respective mold cavities.

Figure 3:
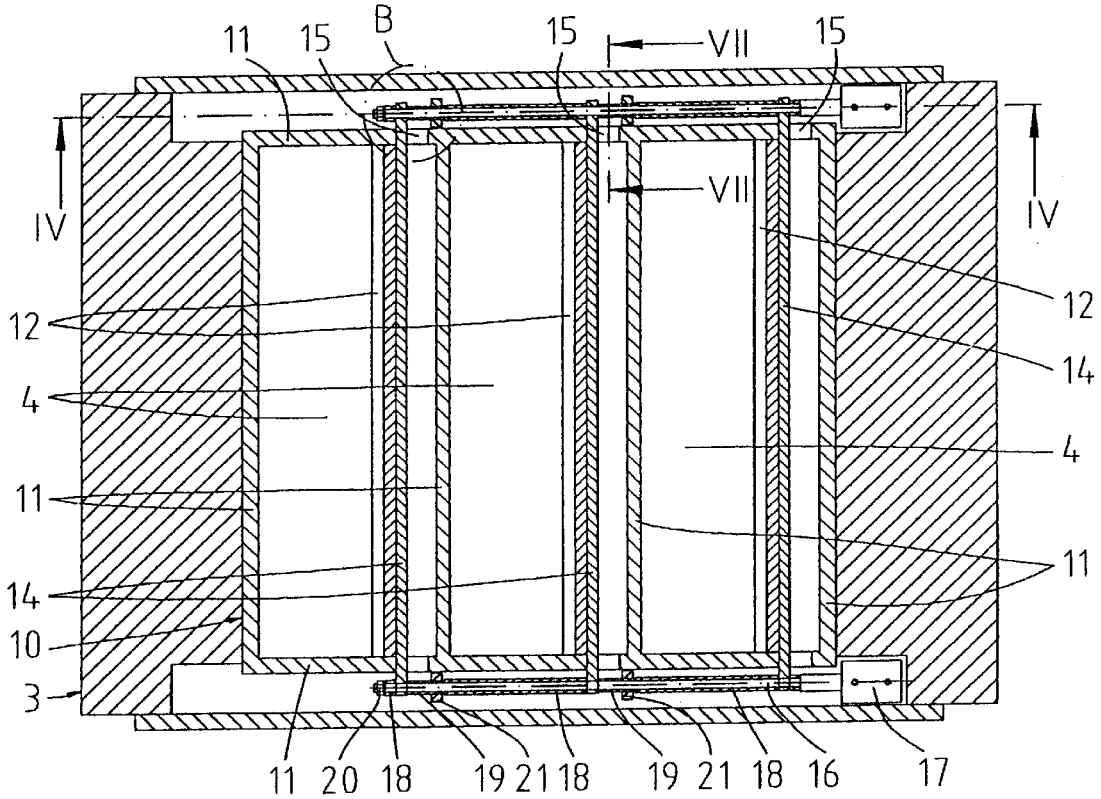
FIG. 3 is a sectional view taken along the line III—III of FIG. 1.

The mold cavities 4 are situated in a mold insert 10 which is securely connected to mold 3 by a detachable clamping connection (FIG. 3). The mold insert 10 comprises three mold cavities 4 in the present embodiment. Each mold cavity 4 is formed by three vertical mold walls 11 which consist of a longitudinal vertical mold wall, two end vertical mold walls and an oblique or inclined movable mold wall 12 which forms with the opposing longitudinal mold wall 11 an angle that is open upwardly. Thus, the inclined mold wall 12 diverges upwardly from its opposed vertical longitudinal wall.

As can be seen in FIG. 1, the inclined mold wall 12 is trapezoidal in cross section with an inner surface that is inclined and rests upon a similarly inclined control surface 13 on the edge of the pressure plate 9. In this embodiment, the inclination of the control surface 13 corresponds to the inclination of the mold wall 12. Using the oblique mold wall 12, a finished shaped brick will thus receive the desired incline or slope on one face and thus, may be used, for example, as a stair.

Figure 5:
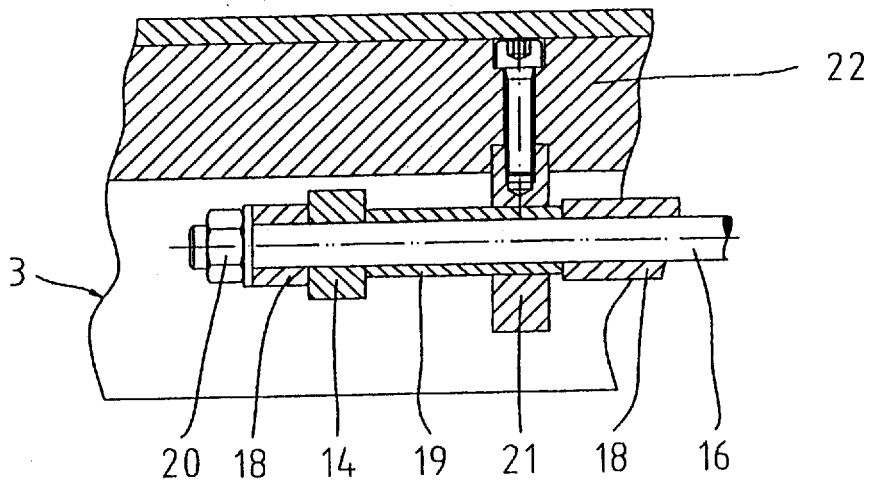
FIG. 5 is an enlarged view of detail A shown in FIG. 4.

The three inclined mold walls 12 of the three mold cavities 4 are each provided with a support 14 whose ends extend outwardly through openings 15 in the end mold walls 11 and the ends of the support 14 on one side of the mold are connected to a piston rod 16 extending from a single-action hydraulic cylinder that is arranged laterally to the mold 3 (FIGS. 3 and 5). The other ends of the support 14 are similarly connected to a like piston rod and cylinder arranged on the other side of the mold as again shown in FIG. 3.

Figure 4:
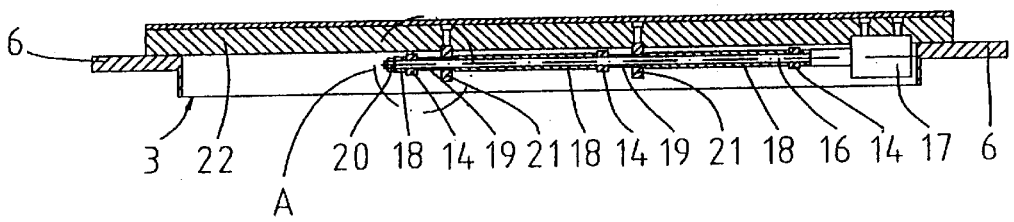
FIG. 4 is a sectional view taken along the line IV—IV in FIG. 3.
Figure 6:
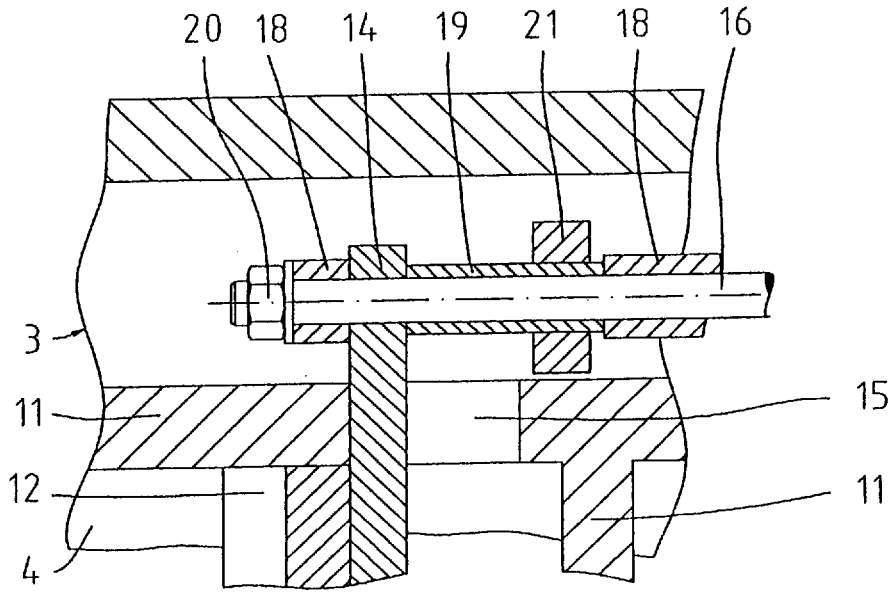
FIG. 6 is an enlarged view of detail B shown in FIG. 3.
Figure 7:
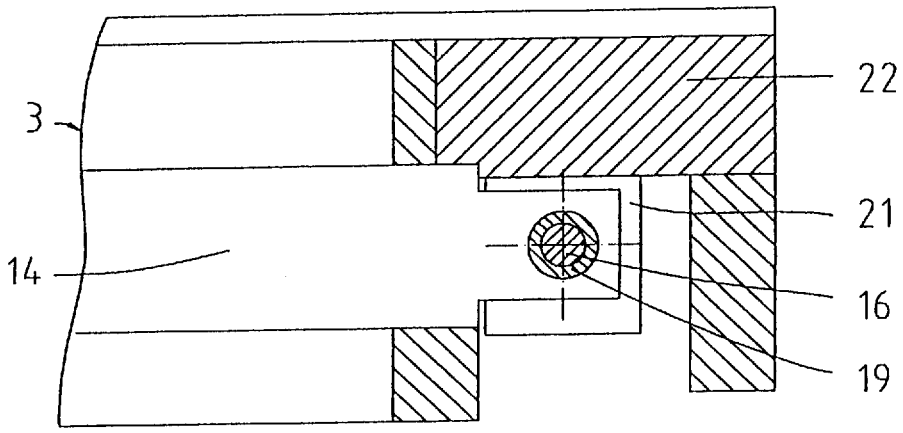
FIG. 7 is a sectional view taken along the line VII—VII in FIG. 3 in enlarged scale.

Piston rod 16 is enclosed by spacers 18 and bearing bushes 19 which are tightened against one another with a screw 20 at the end of the piston rod 16. Thus, bush bearing 19 is clamped respectively between a spacer 18 and support 14 which is penetrated by the piston rod 16 as can be seen in FIG. 5. Bush bearings 19 are movably mounted in bearings 21 which are attached to the underside of a base plate 22 (FIGS. 4 and 6). In this manner, a unit which consists of the three inclined mold walls 12 and supports 14 can be moved horizontally within mold 3 together with piston rod 16 which are integrated into the mold 3.

Figure 2:
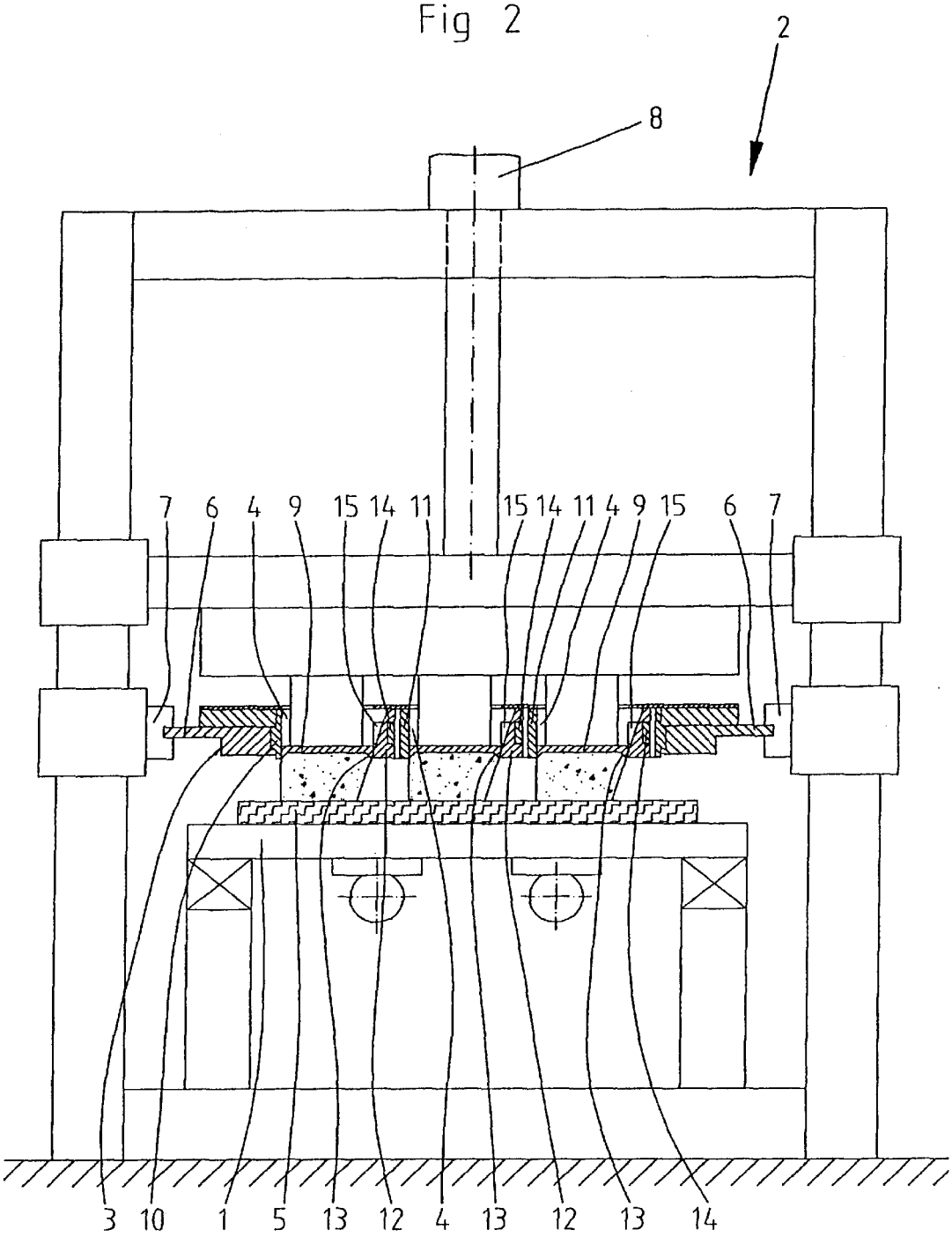
FIG. 2 is a view similar to that of FIG. 1 but showing the mold in its raised position after removal of the shaped bricks from the mold and also partially cut away.

In operation, the mold cavities 4 are first filled with a suitable concrete compounds vibrated and sealed in the position according to FIG. 1 by lowering the pressure plates 9. After the filling and vibrating processes, the mold 3 is raised by the movable support 7 into the position shown in FIG. 2 so as to enable the finished shaped bricks to be removed from the mold. As the mold 3 moves vertically upward, the inclined inner surface of mold wall 12 will slide along control surface 13 of pressure plate 9. As a result, a horizontal movement of the inclined mold walls 12, supports 14, and piston rod 16 is produced since the single-action hydraulic cylinder 17 are not under pressure and the pistons are pushed back against the resistence of the hydraulic fluid that is free to flow out of the cylinder. Thus, a combined vertical and horizontal movement is produced as a result of which the inclined mold wall 12 moves upwardly in the direction of its inclined surface. The movement of the inclined mold wall 12 against the corresponding inclined outer surface of the shaped brick will be molded and smoothed out. Depending on the position according to FIG. 2, the mold 3 together with pressure plates 9 can be moved further upwardly so that the finished shaped bricks can be transported away by removing the storage board 5 on which they rest.

As a modification,instead of control surface 13 on pressure plate 9, a linkage system positioned outside of the mold cavity 4 can also be used and this linkage will also produce a movement of the inclined side walls 12 that is directed obliquely upwardly by a simulated movement.

As a further modification, it is also possible to use as hydraulic cylinder 17 a cylinder that has a double action instead of a single action and to combine this cylinder by means of a suitable program control with the piston-cylinder unit that produces the vertical movement of mold 3 and this will ensure that the desired inclined or oblique movement of inclined mold wall 12 is similarly achieved.

By the utilization of such a program control or with a suitably constructed linkage system, shaped bricks with geometrically differently shaped side walls, for example curved side walls, can also be produced with the same advantages as described above.

It will be understood that this invention is susceptible to modification in order to adapt it to different usages and conditions, and accordingly, it is desired to comprehend such modifications within this invention as may fall within the scope of the appended claims.

What is claimed is:

1. A mold for the production of shaped brick comprising means (4) in said mold (3) for defining one or more mold cavities, said means comprising a longitudinal vertical side wall (11), opposed end vertical side walls and an inclined longitudinal side wall (12) opposed from said longitudinal vertical side wall (11) for each said mold cavity, said inclined longitudinal side wall diverging upwardly with respect to the opposed longitudinal side wall of a said mold cavity to define an upwardly opening angle therewith, and means for moving a said inclined side wall upwardly in the direction in which it is inclined to open the mold so that the shaped brick can be removed.

2. A mold as claimed in claim 1 wherein said inclined side wall moves both vertically and horizontally during opening of the mold.

3. A mold as claimed in claim 1 wherein said means for moving comprises a linkage.

4. A mold as claimed in claim 1 and further comprising means for moving said inclined longitudinal side wall horizontally within the mold, and means for moving the mold vertically upwardly such that the longitudinal vertical side wall and inclined side wall are moved upwardly.

5. A mold as claimed in claim 4 wherein said mold further comprises one or more pressure plates corresponding to said one or more mold cavities and each of said pressure plates covering each of said mold cavities to define a top wall therefor, one of said pressure plates having an inclined control surface along which an inclined side wall slides during vertical lifting of the mold.

6. A mold as claimed in claim 1 wherein said mold comprises a plurality of mold cavities and a corresponding plurality of inclined side walls each disposed respectively in a mold cavity, said inclined side walls each having first and second ends, a pair of lateral pistol rods (16) each attached to the first and second ends respectively of said inclined side walls such that said inclined side walls are movable longitudinally within the mold, and a pair of hydraulic cylinders (17) each respectively connected to a said piston rod to define a plurality of piston-cylinder units.

7. A mold as claimed in claim 6 and further comprising a mold insert (10) detachably connected in said mold to define said plurality of mold cavities, said mold insert having lateral recesses (15) therein, a plurality of supports (14) each attached to one of said inclined side walls and having ends extending through said lateral recesses, said support ends connected to said piston rod (16).

8. A mold as claimed in claim 6 wherein said hydraulic cylinders each have a single action.

9. A mold as claimed in claim 6 wherein said hydraulic cylinders each have a double action, and a program control connecting said hydraulic cylinders to the piston-cylinder units producing a vertical movement of the mold (3).

* * * * *